US005353479A

United States Patent [19]

Lucier

[11] Patent Number: 5,353,479

[45] Date of Patent: Oct. 11, 1994

[54] SUSPENDER CLIP CARRIER

[75] Inventor: Cyril Lucier, Niantic, Conn.

[73] Assignee: Amity Leather Products Co., West Bend, Wis.

[21] Appl. No.: 34,737

[22] Filed: Mar. 19, 1993

[51] Int. Cl.[5] ..... A41F 9/00

[52] U.S. Cl. ..... 24/326; 24/327; 24/519; 2/327

[58] Field of Search ..... 24/326, 229, 330, 335, 24/336, 307, 198, 518, 519, 515, 516; 2/320, 325, 326, 327

[56] References Cited

U.S. PATENT DOCUMENTS

| | | | |
|---|---|---|---|
| D. 312,347 | 11/1990 | Brown et al. | D2/626 |
| D. 316,775 | 5/1991 | Shott | D2/626 |
| 287,020 | 10/1883 | Greely . | |
| 322,480 | 7/1885 | Potter | 2/327 |
| 457,448 | 8/1891 | Clawson . | |
| 622,349 | 4/1899 | Halstenbach . | |
| 648,257 | 4/1900 | Heyman . | |
| 666,770 | 1/1901 | Miller . | |
| 734,861 | 7/1903 | Harris . | |
| 799,464 | 9/1905 | Heilbron . | |
| 813,296 | 2/1906 | Hoopes | 24/326 |
| 900,090 | 10/1908 | Fisher . | |
| 1,221,966 | 4/1917 | Brown . | |
| 1,305,073 | 5/1919 | Decker | 24/326 |
| 1,357,574 | 11/1920 | McDonald | 24/518 |
| 1,579,375 | 4/1926 | Levey | 24/326 |
| 1,800,671 | 4/1931 | Zimmerer et al. . | |
| 1,803,214 | 4/1931 | Siegel . | |
| 1,823,369 | 9/1931 | McCulloch . | |
| 1,962,021 | 6/1934 | Lobbenberg . | |
| 2,040,635 | 5/1936 | Sobel | 24/245 |
| 5,036,552 | 8/1991 | Deakyne | 24/519 |

FOREIGN PATENT DOCUMENTS

| | | | |
|---|---|---|---|
| 47353 | 5/1933 | Denmark . | |
| 7708480 | 10/1978 | Sweden | 24/326 |
| 124748 | 3/1928 | Switzerland . | |

*Primary Examiner*—Victor N. Sakran
*Attorney, Agent, or Firm*—DeLio & Peterson

[57] ABSTRACT

A clip carrier for supporting a suspender clip comprising double ply flexible material having a pocket between the plies and an opening through one of the plies into the pocket. The opening has a first portion that is utilized to insert the suspender clip into the pocket, and a second portion that is utilized to removably secure the suspender clip within the pocket. The other ply of the flexible material conceals the suspender clip.

4 Claims, 7 Drawing Sheets

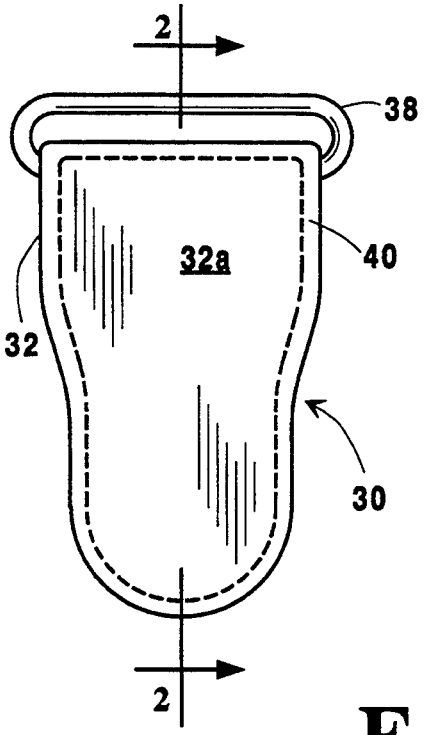
Fig. 1
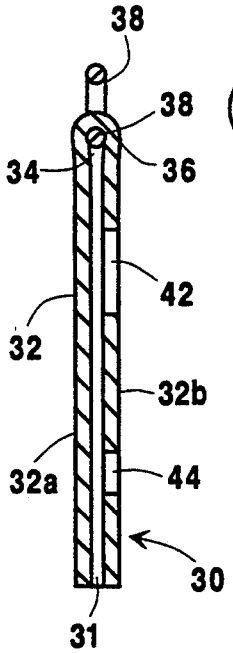
Fig. 2
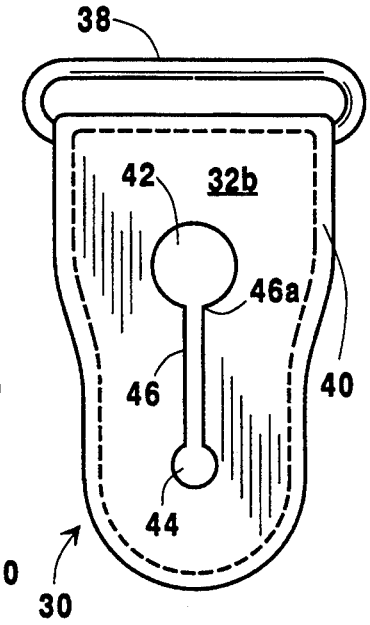
Fig. 3
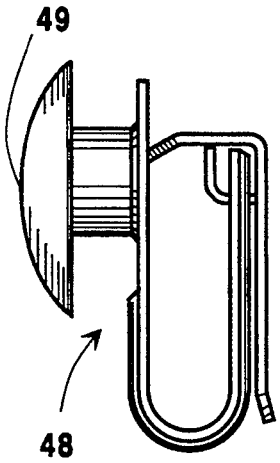
Fig. 4
(PRIOR ART)
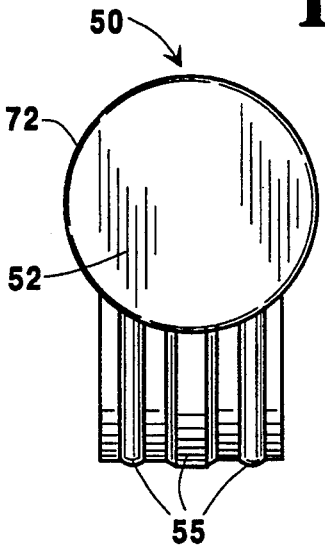
Fig. 5
Fig. 6
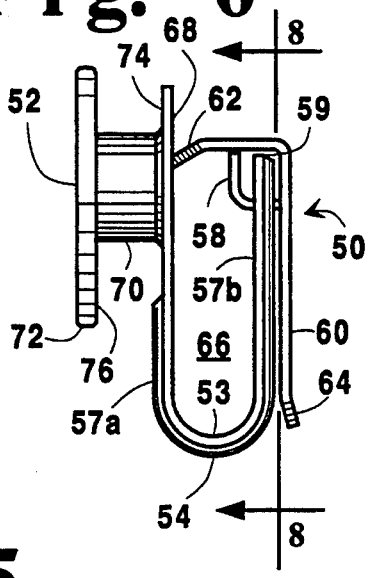

SUSPENDER CLIP CARRIER

BACKGROUND OF THE INVENTION

1. Field he Invention

This invention relates to suspender clip carriers for use with suspenders of the type which are worn over the shoulders to support trousers. More specifically, this invention relates to a suspender clip carrier which may be used with a suspender clip that is attached to the clip carrier in such a manner that the suspender clip faces the waist of the user of the suspenders and is thus concealed by the clip carrier.

2. Description of Related Art

Some trousers are provided with buttons inside the waistband for connection to suspenders having buttonholes on button strap connectors at the end of the suspender straps. Other types of trousers are not provided with suspender buttons, and suspenders for use with these trousers include clips that releasably engage the waistband. These clips are fatally visible and detract from the aesthetic qualities of the suspenders. Furthermore, visibility of these clips is a characteristic that is found undesirable by many who use such suspenders.

Bearing in mind the problems and deficiencies of the prior art, it is therefore an object of the present invention to provide a new and improved suspender clip carrier which securely retains a suspender clip thereto, and is attachable to a corresponding suspender strap in a manner such that during use, the suspender clip carrier conceals the suspender clip.

Another object of the present invention is to provide a rugged, reliable, inexpensively manufactured suspender clip carrier which does not accidentally become disengaged from the suspender clip attached thereto.

SUMMARY OF THE INVENTION

The above and other objects, which will be apparent to those skilled in the art, are achieved in the present invention which is directed to a suspender clip carrier for supporting a suspender clip comprising double ply flexible material having a pocket between the plies and an opening through one of the plies into the pocket. The opening has a first portion that is utilized to insert the suspender clip into the pocket. The opening has a second portion that is utilized to removably secure the suspender clip within the pocket. The other ply conceals the suspender clip, thereby precluding others from viewing the suspender clip. The clip carrier includes a connection ring which is partially disposed within a channel formed between the plies at an upper end of the clip carrier. The connection ring is utilized for attaching the clip carrier to a corresponding suspender strap.

In a related aspect, the present invention is directed to a clip carrier for supporting a suspender clip comprising double ply flexible material having a pocket between the plies and first, second, third and fourth openings through one of the plies into the pocket. The first and second openings are substantially horizontally aligned and located in the upper portion of the ply. The third and fourth openings are substantially centered in the center and lower portions, respectively, of the ply. A connection ring is partially disposed within a channel formed at the upper end of the clip carrier. The connection ring is utilized for attaching the clip carrier to a corresponding suspender strap. The clip carrier is utilized with a suspender clip that comprises a base portion, a first jaw attached to a first end of the base portion, a C-shaped connector attached to a second end of the base portion and having a pair of horizontal inwardly extending arms at its upper end, a pair of upstanding support arms projecting from and attached to the base at a point intermediate the first jaw and the C-shaped connector, a jaw support member hingedly mounted to the support arms and having a second jaw attached to the side thereof that faces the first jaw, and a latch hingedly mounted to the support arms in a manner such that the jaw support member is intermediate the base portion and the latch. The first and second jaws are openable and closeable via the latch. The base portion is rigidly secured within the pocket in a manner such that the first jaw protrudes from the fourth opening in the ply, the upstanding support arms protrude from the third opening in the ply, and each extending arm of the C-shaped connector protrudes into the first and second openings, respectively, in the ply. The user manipulates the latch in order to close or open the jaws so as to retain or release, respectively, the waistband of the trousers. The other ply of the suspender clip carrier conceals the suspender clip, thereby precluding others from viewing the suspender clip.

BRIEF DESCRIPTION OF THE DRAWINGS

For a fuller understanding of the invention, reference is made to the following description taken in connection with the accompanying drawings, in which:

FIG. 1 is a front elevational view of the suspender clip carrier of the present invention;

FIG. 2 is a side elevational view in cross-section of the suspender clip carrier taken along line 2—2 of FIG. 1;

FIG. 3 is a back elevational view of the suspender clip carrier of FIG. 1;

FIG. 4 is a side elevational view of a suspender clip of the prior art;

FIG. 5 is a front elevational view of the suspender clip for utilization with the suspender clip carrier of the present invention;

FIG. 6 is a side elevational view of the suspender clip shown in FIG. 5 looking from the right edge of the drawing, the view of the clip from the left edge of the drawing being essentially the same;

DESCRIPTION OF THE PREFERRED EMBODIMENTS

Figure 7:
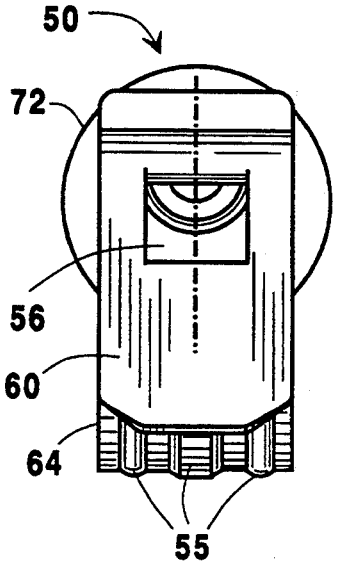
FIG. 7 is a back elevational view of the suspender clip shown in FIG. 5.

The present invention is described within with reference to drawing FIGS. 1–20 in which like numerals refer to like features of the invention. Features of the invention are not necessarily shown to scale.

Referring to FIGS. 1, 2 and 3, clip carrier 30 of the present invention comprises a single piece of flexible material 32 horizontally folded down and sewn upon itself to form first ply 32*a* and second ply 32*b*. In a preferred embodiment, flexible material 32 is leather. However, any pliable material, such as plastic, can be utilized. Channel 34 is formed within fold 36. Connection ring 38 is partially disposed within channel 34 and is utilized for attaching clip carrier 30 to suspender strap 78 (see FIG. 20). Since flexible material 32 is sewn along edge 40, a pocket 31 is formed between plies 32*a* and 32*b*. Clip carrier 30 has first and second openings 42 and 44, respectively, in ply 32*b*. Opening 42 has a shape that is substantially circular and is substantially centered in the upper portion of ply 32*b*. Opening 44 has a shape that is substantially circular and substantially centered in the lower portion of ply 32*b*. The diameter of opening 42 is substantially larger than that of opening 44. Substantially vertically extending slit 46 extends between and joins openings 42 and 44.

Figure 8:
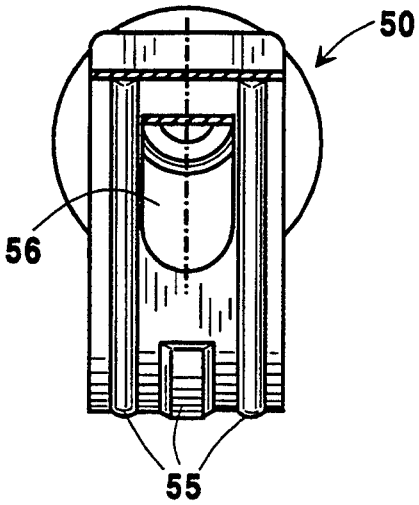
FIG. 8 is a sectional view taken along line 8—8 of FIG. 6.

Clip carrier 30 is utilized with suspender clip 50, which is shown in FIGS. 6–8. Clip 50 is a modified version of suspender clip 48, shown in FIG. 4. Suspender clip 48 is the subject of commonly assigned U.S. Pat. No. 313,116, the disclosure of which is herein incorporated by reference. As shown in FIG. 6, surface 52 of clip 50 is substantially flat, contrary to the curved surface 49 of clip 48. All other features and functional characteristics of Clip 50 are the same as those of clip 48. Referring to FIG. 6, U-shaped portion 54 includes closed end 53 and opposed sides 57*a*, 57*b*.Ribs 55 add structural support to U-shaped portion 54. U-shaped portion 54 has an opening 56 therein (see FIG. 8) for receiving curved lip 58, which is rigidly connected to L-shaped latch 60. Lip 58 acts as a hinge thereby allowing latch 60 to pivot about end 59 of U-shaped portion 54. End 64 of latch 60 is angulated away from U-shaped portion 54 so as to enable the user of the clip carrier to easily lift latch 60 in order to insert a portion of the waistband 80 of the user's trousers 82 (see FIG. 20) into cavity 66 of U-shaped portion 54. End 62 of latch 60 is angulated into cavity 66 so as to facilitate frictional contact between end 62 and inner surface 68 of U-shaped portion 54 when latch 60 is in a closed position, as shown in FIG. 6.

Figure 9:
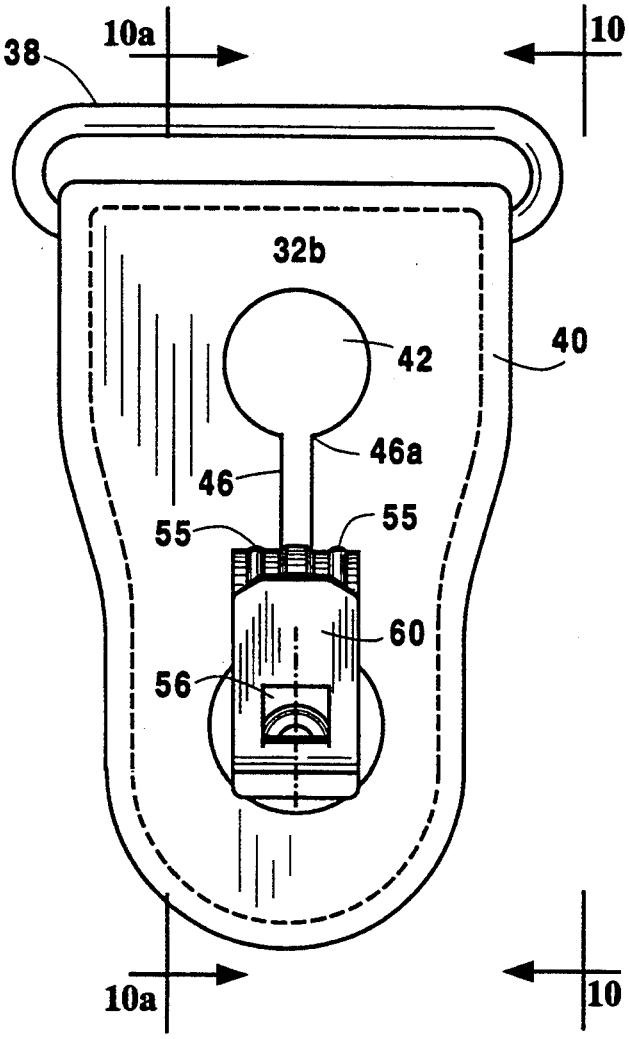
FIG. 9 shows the suspender clip of FIG. 5 removably secured to the suspender clip carrier depicted in FIG. 3.
Figure 10:
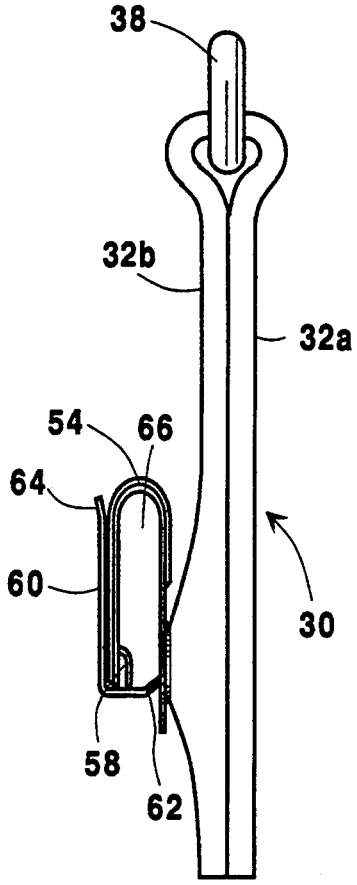
FIG. 10 is a side elevational view taken along line 10—10 of FIG. 9.
Figure 10A:
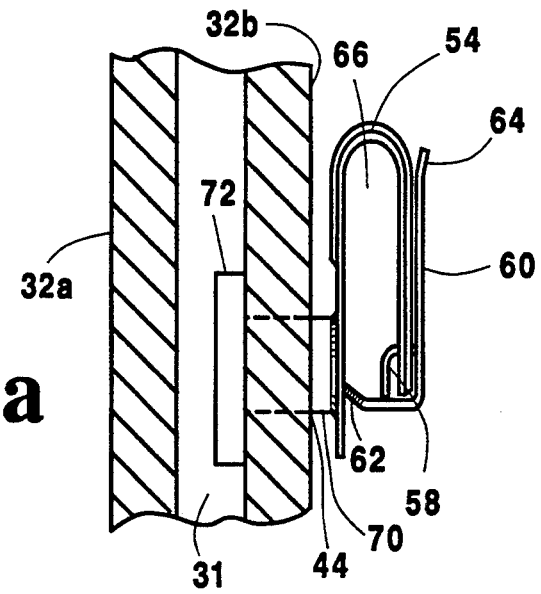
FIG. 10*a* is an enlarged partial sectional view taken along line 10*a*—10*a* of FIG. 9.

Stub or tab 70 has a substantially cylindrical shape and is rigidly fixed between outer surface 74 of U-shaped portion 54 and inner surface 76 of support plate 72. Support plate 72 is substantially circular shaped and has a substantially flat outer surface 52. The diameter of plate 72 is substantially the same as that of opening 42. In order to attach a portion of the waistband to clip 50, the user first lifts latch 60 and inserts a portion of the waistband into cavity 66 of U-shaped portion 54. Once a sufficient amount of waistband 80 is allowed to enter cavity 66, the user maneuvers latch 60 so that end 62 of latch 60 frictionally contacts waistband 80 and presses waistband 80 against inner surface 68 of U-shaped portion 54, thereby securing the waistband within cavity 66. Referring to FIGS. 9, 10 and 10*a*, in order to attach suspender clip ,50 to clip carrier 30, the user spreads slit 46 and inserts support plate 72 of clip 50 into pocket 31 via an opening defined substantially by opening 42 and upper portion 46*a* of opened slit 46. The user then maneuvers clip 50 so that support plate 72 and stub 70 become removably secured within pocket 31 in such a manner that stub 70 is positioned within opening 44 (see FIG. 10*a*). Ply 32*a* of suspender clip carrier 30 conceals suspender clip 50.

Figure 20:
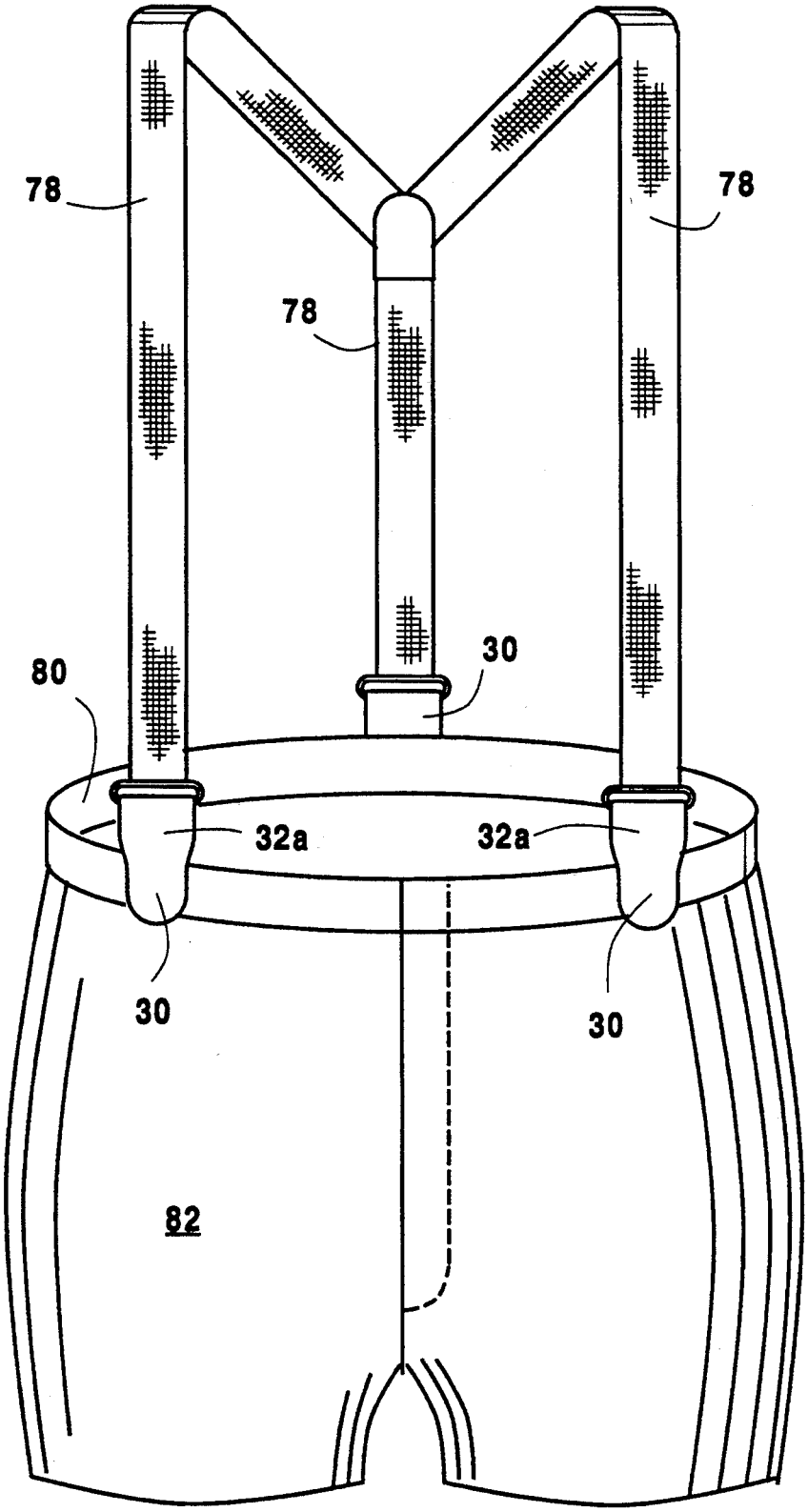
FIG. 20 is a perspective view of the suspender clip carrier of FIG. 1 utilized with a suspender strap, the view of the alternate embodiments of FIGS. 11 and 13 being essentially the same.

When attached to suspender strap 78 (see FIG. 20), the elasticity of the suspender strap produces a tensile force which causes support plate 72 and stub 70 to remain removably secured within pocket 31. Since the diameter of support plate 72 is substantially larger than that of opening 44, plate 72 remains secured within pocket 31 until it is removed by the user. Clip 30 is disengaged from clip carrier 30 by maneuvering clip carrier 30 in a manner such that the support plate 72 becomes positioned at opening 42. The user then spreads slit 46 in order to remove support plate 72 from pocket 31. As shown in FIG. 20, ply 32*a* of suspender clip carrier 30 conceals suspender clip 50, thereby precluding others from viewing the clip.

Figure 11:
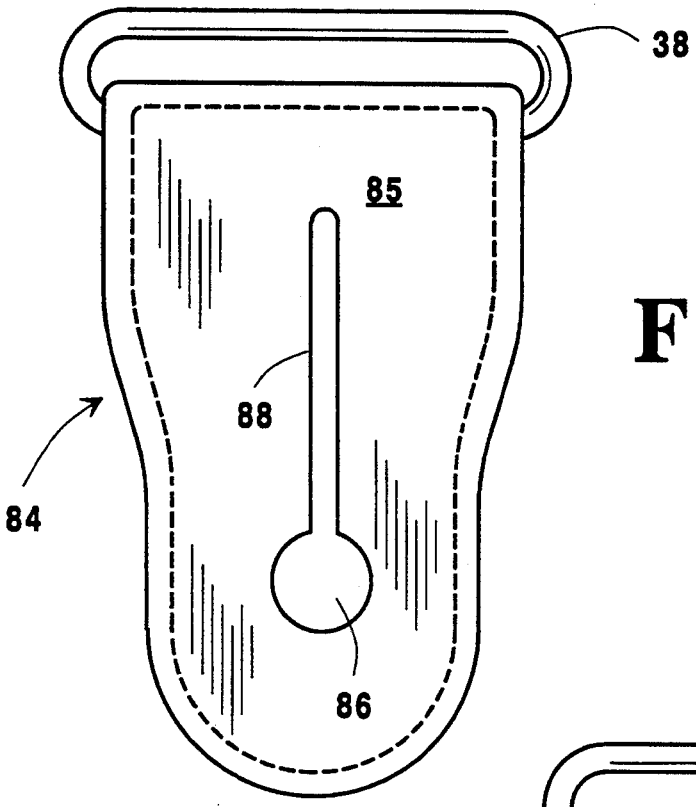
FIG. 11 is a back elevational view of an alternate embodiment of the suspender clip of FIG. 1.
Figure 12:
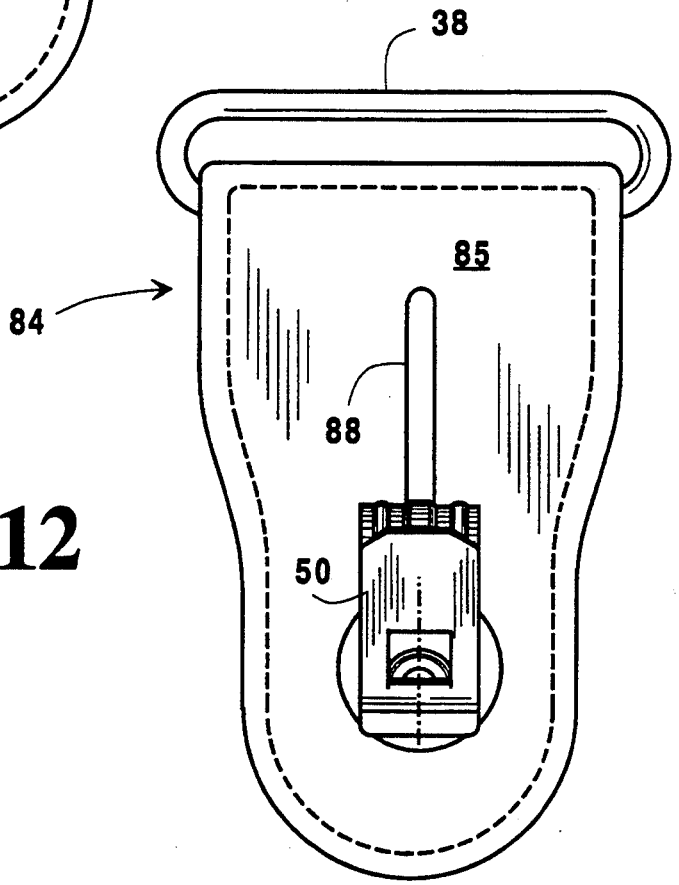
FIG. 12 shows the suspender clip of FIG. 5 removably attached to the alternate embodiment depicted in FIG. 11.

FIG. 11 shows an alternate embodiment of the clip carrier of the present invention. Clip carrier 84 is identical in construction to clip carrier 30 with the exception being that there is only one opening 86 in ply 85. Opening 86 has a substantially circular shape and is substantially centered in the bottom portion of clip carrier 84. Elongated slot 88, which is substantially centered in ply 85, extends substantially vertically from opening 88. As shown in FIG. 12, suspender clip 50 is attached to clip carrier 84 in the same manner as was previously described for clip carrier 30. However, since there is only one opening in ply 85, the user must spread slit 88 to a greater degree in order to insert or remove support plate 72 into or from, respectively, the pocket (not shown) of clip carrier 84. In order to attach suspender clip 50 to clip carrier 84, the user spreads slit 88 and inserts support plate 72 of clip 50 into the pocket (not shown). The user then maneuvers clip 50 so that support plate 72 and stub 70 become removably secured within the pocket of carrier 84 in such a manner that stub 70 is positioned within opening 86 (see FIGS. 11 and 12).

When attached to a suspender strap, the elasticity of the suspender strap produces a tensile force which causes support plate 72 and stub 70 to remain removable secured within the pocket of carrier 84. Since suspender clip carriers 30 and 84 have the same perimetrical shape, FIG. 20 is also an accurate representation of the utilization of suspender clip 84 with corresponding suspender straps.

Figure 13:
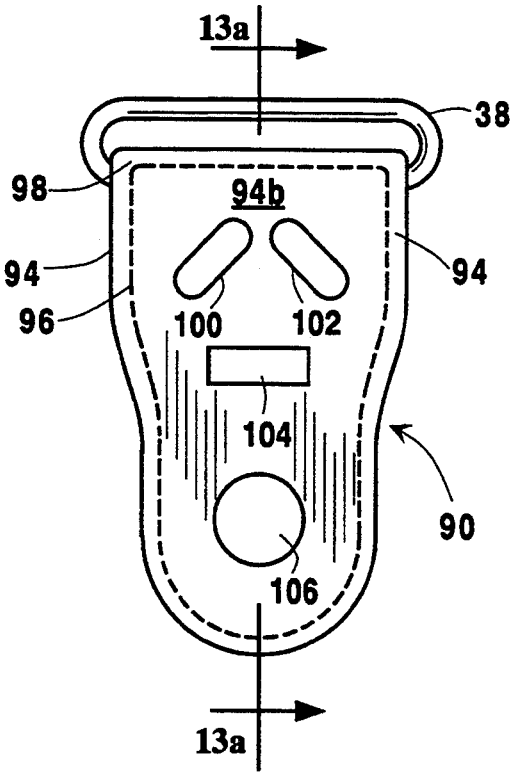
FIG. 13 is a back elevational view of a further embodiment of the suspender clip carrier of FIG. 1.
Figure 13A:
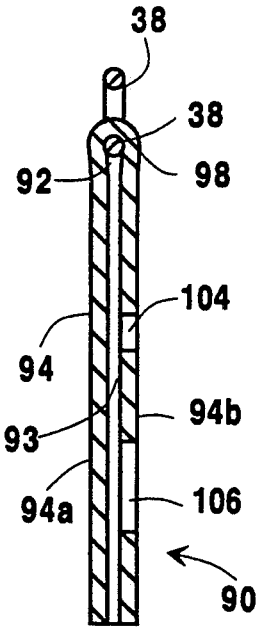
FIG. 13*a* is a cross-sectional view taken along 13*a*—13*a* of FIG. 13.

FIGS. 13 and 13*a* shows a further embodiment of the clip carrier of the present invention. Similar to clip carrier 30 and 84, clip carrier 90 is comprised of a single piece of flexible material 94 horizontally folded down and sewn upon itself to form two plies, 94*a* and 94*b*. In a preferred embodiment, flexible material 94 is leather. However, any pliable material, such as plastic, can be utilized. Connection ring 38 is partially disposed within channel 92 which is formed within fold 98. Connection ring 38 is utilized for attaching clip carrier 90 to a suspender strap in the same manner as clip carrier 30 is attached to suspender strap 78 in FIG. 20. Ply 94*b* has openings 100, 102, 104 and 106 therein which lead into pocket 93. Openings 100, 102, which are substantially oval shaped, are horizontally aligned and are located in the upper portion of ply 94*b*. Each opening is the same distance from edge 96. Opening 104 is substantially rectangular shaped and is substantially centered in the center portion of ply 94*b*. Opening 106 is substantially circular shaped and is substantially centered in the lower portion of ply 94*a*. Opening 106 is vertically aligned with opening 104.

Figure 14:
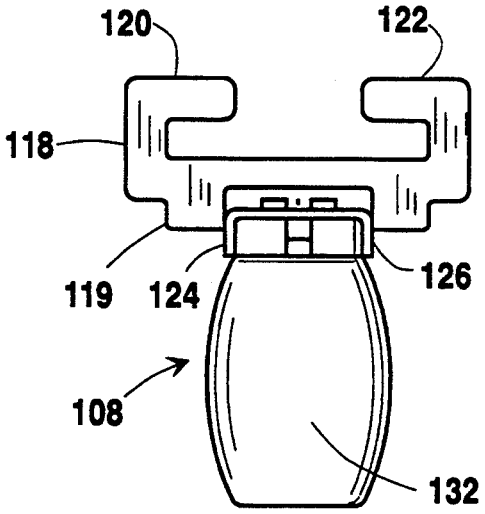
FIG. 14 is a front elevational view of a suspender clip for utilization with the suspender clip carrier of FIG. 13.
Figure 15:
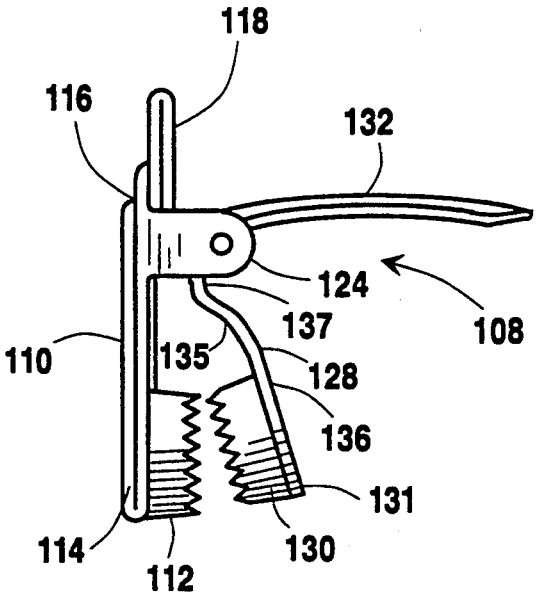
FIG. 15 is a side elevational view of the suspender clip of FIG. 14 with its jaws in the open position.
Figure 16:
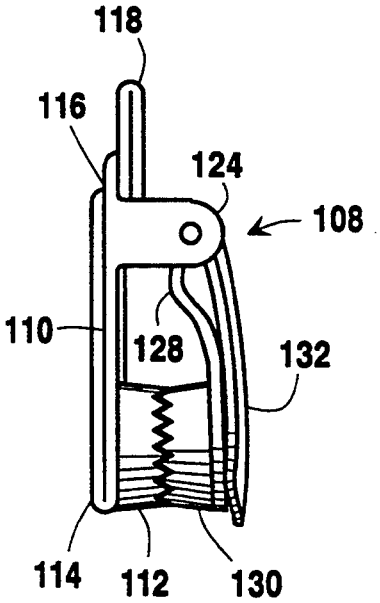
FIG. 16 is a side elevational view of the suspender clip of FIG. 14 with its jaws in the closed position.
Figure 17:
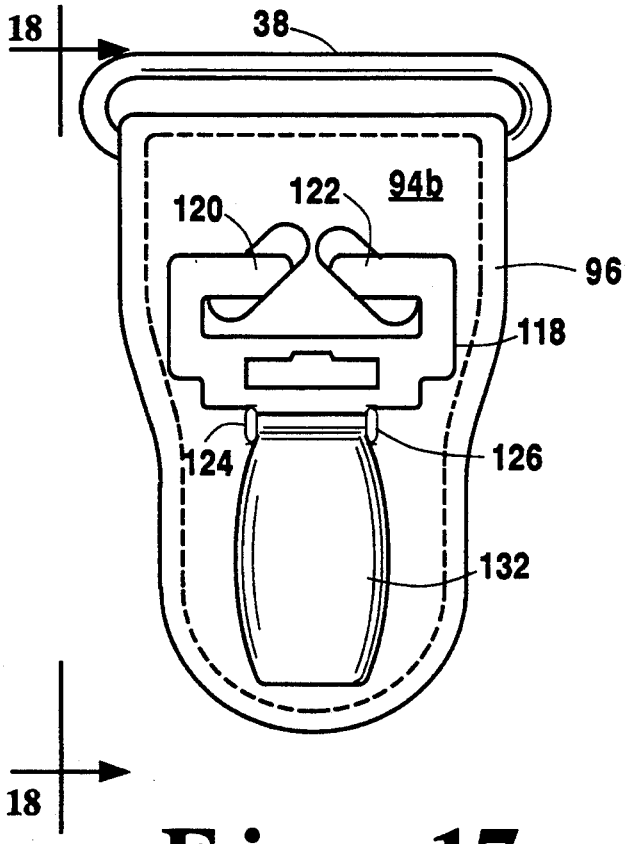
FIG. 17 is a front elevational view of the suspender clip carrier of FIG. 13 having attached thereto the suspender clip of FIG. 14.
Figure 18:
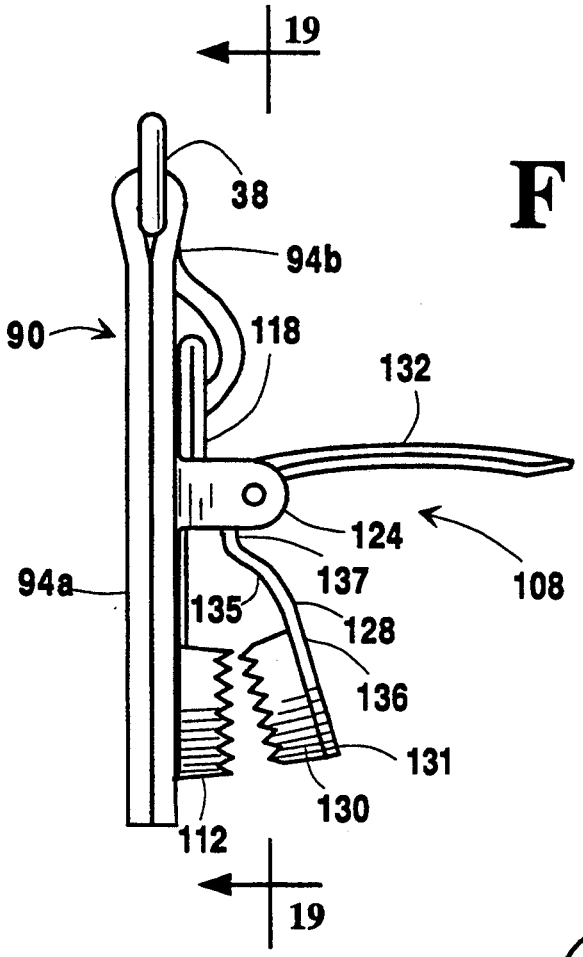
FIG. 18 is a side elevational view taken along line 18—18 of FIG. 17.
Figure 19:
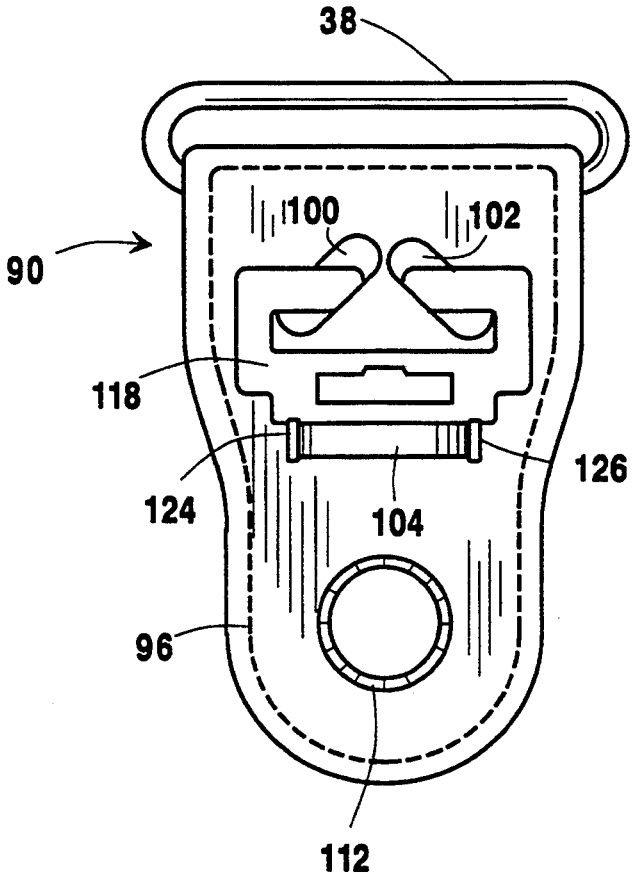
FIG. 19 is a front elevational view taken along line 19—19 of FIG. 18.

Suspender clip carrier 90 is utilized with suspender clip 108 shown in FIGS. 14–16. Base 110 has substantially circular shaped jaw 112 rigidly connected thereto and located adjacent end 114. Bottom portion 119 of C-shaped connector 118 is rigidly connected to end 116 of base 110. C-shaped connector 118 has a pair of inwardly extending horizontal arms 120, 122 positioned at the top thereof. Upstanding support arms 124, 126 project from and are rigidly connected to base 110 intermediate C-shaped connector 118 and jaw 114. Jaw support member 128 is hingedly mounted to support arms 124, 126. Member 128 has ends 130, 137 and sides 135, 136. Member 128 has substantially circular jaw 130 rigidly connected to side 135 thereof and located adjacent end 131. Latch 132 is hingedly mounted to support arms 124, 126 in a manner such that jaw support member 128 is intermediate base 110 and latch 132. Latch 132 contacts the portion of side 136 of member 128 that is adjacent end 137 whereby when latch 132 is lowered, as shown in FIG. 16, jaws 112 and 130 are pressed against one another. When latch 132 is raised, as shown in FIG. 18, jaw 130 is retracted from contact with jaw 112. Referring to FIGS. 13*a*, 17, 18 and 19, during assembly, base 110 is substantially secured in pocket 93 in such a manner that jaw 112 and upstanding support arms 124, 126 protrude through openings 106 and 104, respectively. Latch arm 132 is not shown in FIG. 19 so as to facilitate a clear view of clip 108 when secured in the pocket 93. In order to secure a portion of the waistband of the trousers to clip 108, the user lifts latch 132 so as to separate jaws 112 and 130 from each other and inserts the waistband between jaws 112 and 130. The user then lowers latch 132 so jaws 112 and 130 lock together with the portion of the waistband therebetween. Ply 94*a* of clip carrier 90 conceals suspender clip 108, thereby precluding others from viewing the clip. Since suspender clip carriers 30 and 90 have substantially the same perimetrical shape, FIG. 20 is also an accurate representation of the utilization of suspender clip carrier 90 with corresponding suspender straps.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. In a suspender comprising shoulder straps and suspender clips for attachment to clothing, a suspender clip carrier for concealment of said suspender clip, said carrier comprising a planar body having a front side and a rear side, securing means for securing said carrier to said shoulder straps, and means for attaching a corresponding suspender clip to said rear side of said carrier, said suspender clip carrier being substantially larger in size than said suspender clip whereby said front side of said suspender clip carrier conceals said suspender clip wherein said planar body portion comprises double ply flexible material formed by a single piece of flexible material horizontally folded down and sewn upon itself.

2. The suspender clip carrier of claim 1 wherein said securing means comprises a connection ring partially disposed within a channel formed within said fold, said ring being utilized to secure said clip carrier to a corresponding one of said suspender straps.

3. The suspender clip carrier of claim 19 wherein each of said clips is removably attached to a corresponding one of said clip carriers.

4. Suspenders having suspender clip carriers for concealment of the suspender clip comprising:

shoulder straps;

a plurality of suspender clip carriers, each of which being associated with a corresponding one of said straps, each of said carriers comprising a planar body having a front side and a rear side formed by a single piece of double ply flexible material folded down and sewn upon itself;

securing means for securing each of said suspender clip carriers to said shoulder straps;

a plurality of suspender clips, each of which being associated with a corresponding one of said suspender clip carriers; and means for attaching each of said clips to said rear side of said corresponding one of said suspender clip carriers, each of said suspender clip carriers being substantially larger in size than said suspender clip attached thereto whereby said front side of said suspender clip carrier conceals said suspender clip.

* * * * *

UNITED STATES PATENT AND TRADEMARK OFFICE

CERTIFICATE OF CORRECTION

PATENT NO. : 5,353,479

DATED : October 11, 1994

INVENTOR(S) : Lucier

It is certified that error appears in the above-identified patent and that said Letters Patent is hereby corrected as shown below:

In column 1, line 21, please delete "fatally" and substitute therefore - -totally- -.

In column 3, line 48, after "Pat", please insert - -Des.- -.

In column 4, line 16, after "clip" and before "50", please delete ",".

In column 6, line 29, after the second "clip", please insert - -, and - -.

In column 6, line 38, please delete "19" and substitute therefor - -1- -.

Signed and Sealed this

Thirty-first Day of January, 1995

*Attest:*

*Attesting Officer*

Bruce Lehman

BRUCE LEHMAN

*Commissioner of Patents and Trademarks*